US006320571B1

(12) United States Patent
Takahashi et al.

(10) Patent No.: US 6,320,571 B1
(45) Date of Patent: Nov. 20, 2001

(54) BISTABLE LIQUID CRYSTAL DISPLAY DEVICE

(75) Inventors: Hiroyuki Takahashi, Yokohama; Kenji Kameyama, Sagamihara, both of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/152,339

(22) Filed: Sep. 14, 1998

(30) Foreign Application Priority Data

Sep. 12, 1997 (JP) ..... 9-248820

(51) Int. Cl.[7] ..... G09G 5/00

(52) U.S. Cl. ..... 345/204; 345/205; 345/210; 345/211; 345/87; 345/88; 345/92; 345/95; 345/97

(58) Field of Search ..... 345/204, 205, 345/210, 211, 87, 88, 91, 92, 95, 97

(56) References Cited

U.S. PATENT DOCUMENTS

| | | | | |
|---|---|---|---|---|
| 5,742,368 | * | 4/1998 | Chen | 349/117 |
| 5,748,277 | * | 5/1998 | Huang et al. | 349/169 |
| 5,815,132 | * | 9/1998 | Okada et al. | 345/95 |
| 5,840,208 | * | 11/1998 | Yamaguchi et al. | 252/299.63 |
| 5,933,203 | * | 8/1999 | Wu et al. | 349/35 |
| 6,111,696 | * | 8/2000 | Allen et al. | 359/495 |

OTHER PUBLICATIONS

Patent Abstracts of Japan, AN 89–062655/09, JP 01051818, Feb. 28, 1989.

Patent Abstracts of Japan, AN 5–121996, JP 6–230751, Aug. 19, 1994.

Patent Abstracts of Japan, AN 07199825, JP 08101371, Apr. 16, 1996.

Patent Abstracts of Japan, AN 07199824, JP 08313878, Nov. 29, 1996.

* cited by examiner

*Primary Examiner*—Richard Hjerpe
*Assistant Examiner*—Jean Lesperance
(74) *Attorney, Agent, or Firm*—Oblon, Spivak, McClelland, Maier & Neustadt, P.C.

(57) ABSTRACT

A bistable liquid crystal display device having a plurality of display cells which include a pair of substrates arranged substantially in parallel, each substrate having a confronting surface bearing transparent electrodes, and a layer of chiral-nematic liquid crystal materials contained between the substrates. The display device is switched between first and second metastable states caused by relaxation from a state previously formed by the Freedricksz transition, the first and second metastable states corresponding to arrangements of liquid crystal molecules gradually twisted between the substrates by 360° for the first (or T) metastable state, or by 0° for the second (or U) metastable state, respectively, and of maintaining the selected metastable state by applied third voltages. At least either the amplitude or width of the first voltage used to initiate the Freedricksz transition may preferably be adjusted, to thereby provide a liquid crystal display device of high display quality, capable of achieving a high speed drive over a wide range of temperatures.

29 Claims, 7 Drawing Sheets

BISTABLE LIQUID CRYSTAL DISPLAY DEVICE

BACKGROUND OF THE INVENTION

1. Field of the Invention

This invention relates in general to liquid crystal display devices, and more particularly, to bistable twisted-nematic liquid crystal devices and a method of driving such display devices.

2. Discussion of the Background

A great deal of emphasis has been placed in recent years on liquid crystal display devices. With recognized advantages such as low electrical power consumption and small size, liquid crystal display devices are widely used for audio equipment, instrument panels, office automation equipment, and other uses.

Liquid crystals, which include ordered molecules or groups of molecules in a liquid state, are considerably useful for fabricating these devices for switching, modulating, and otherwise altering the characteristics of light beams. Both differences in transmittance and in the polarizing effect of such liquid crystals have been now utilized for fabricating these devices.

However, it would be more practical for a number of new applications to have a liquid crystal material which has two stable states, and which can be easily transformed from one stable state to the other, rapidly and with a minimum expenditure of energy.

To implement a high speed drive of liquid crystal devices, a variety of liquid crystal displays using bistable twisted-nematic (BTN) liquid crystals have been disclosed as exemplified in Japanese Published Patent Application No. 1-51818 and Japanese Laid-Open Patent Applications Nos. 6-230751, 8-101371 and 8-313878.

Bistable characteristics are shown for twisted-nematic liquid crystals in these disclosures, in which at least two pulse voltages are applied to produce an electric field across a liquid crystal cell. A first pulse is used to initiate the Freedricksz transition of the liquid crystal and a second pulse is used to subsequently relax the liquid crystal to either one of two metastable states, thereby modulating optical transmittance or reflectivity to be utilized as display devices.

Although principles for switching behavior of possible displays are presented in JPA 1-51818, no description is made of driving the displays. Also, JPA 6-230751, 8-101371 and 8-313878 propose basics of driving simple matrix type displays. However, no description is made of either the effects of temperature on display quality, or methods of compensating for the effects, which is deemed important for practical purposes for the display devices.

SUMMARY OF THE INVENTION

It is therefore an object of the present invention to provide a novel liquid crystal display device and a method of driving the display device, which overcome the above-noted difficulties.

It is another object of the present invention to provide a novel liquid crystal display device of high display quality, which is capable of achieving a high speed driving over a wide range of temperatures for stable operations, and to provide a method of driving a liquid crystal display device.

To achieve the forgoing and other objects, and to overcome the drawbacks discussed above, a novel liquid crystal display device is provided, having a liquid crystal cell in the present invention. The liquid crystal cell includes two transparent insulating substrates arranged substantially in parallel, each with a confronting surface bearing at least one transparent electrode, an alignment film disposed over the transparent electrode, and a layer of liquid crystal materials contained between the insulating substrates. The liquid crystal material is chiral-nematic liquid crystal with a positive dielectric anisotropy. In addition, the surface of the alignment film is alignment treated with an anti-parallel alignment direction and pre-tilt angles formed on respective alignment film surfaces by a molecular axis of the liquid crystal material at an initial state, being equal to each other, and having a ratio of an unstrained pitch to a thickness of the layer of the liquid crystal material of approximately from 1 to 3.

The liquid crystal cell is capable of being switched by applying a plurality of voltages between first and second metastable states caused by relaxation from a state previously formed by the Freedricksz transition, and the first and second metastable states correspond to arrangements of the liquid crystal molecules gradually twisted between the substrates by 360° or 0°, respectively.

Potential voltages such as first, second, and third voltages are applied between the electrodes of the liquid crystal cell. The first voltage is used to initiate the Freedricksz transition of a layer of liquid crystal molecules, the second voltage is used to select either the first and second metastable states, and the third voltage is used to maintain the selected metastable state.

In the liquid crystal cell of the present invention, according to one aspect, a first voltage is a pulse voltage with a magnitude equal to or greater than a threshold voltage which is determined with respect to an initial state and the two metastable states, and at least either the amplitude or width of the pulse voltage may arbitrarily be adjusted. In addition, the third voltage used to maintain the selected metastable state is a pulse voltage with a magnitude smaller than a threshold voltage determined with respect to the two metastable states.

According to another aspect of the present invention, the liquid crystal cell has a plurality of delineated electrodes on each substrate to serve as scan electrodes or signal electrodes, and each of the electrodes is capable of being individually addressed in a multiplexed fashion by a device for applying voltages.

According to still another aspect of the present invention, the liquid crystal material contained between insulating substrates has a kinetic viscosity of at most 17 ($mm^2$/sec) at 20° C., or of at most 40 ($mm^2$/sec) at 0° C.

According to another aspect of the present invention, liquid crystal material contained between insulating substrates has an anisotropy of dielectric constant of at least 3.0.

According to another aspect of the present invention, the device for applying a voltage is further provided with a control or automatic control having a temperature sensor, to arbitrarily adjust at least either the amplitude or width of the first voltage applied to initiate the Freedricksz transition.

According to another aspect of the present invention, on one of the substrates of the liquid crystal display panel, red, green or blue color filters may further be provided in a matrix corresponding to individual pixels to thereby constitute a color display panel.

Methods are also disclosed for carrying out the driving of the liquid crystal cell by applying first, second, and third voltages between the electrodes, the first voltage being applied to initiate the Freedricksz transition of the layer of the liquid crystal molecules, the second voltage being applied to select either the first and second metastable states, and the third voltage being applied to maintain the selected metastable state. The first voltage is a pulse voltage with a magnitude of at least a threshold voltage determined with respect to an initial state and the two metastable states, and either the amplitude or width of the pulse voltage may arbitrarily be adjusted.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE ILLUSTRATIVE EMBODIMENTS

In the description which follows, specific embodiments of the present invention usefull in liquid crystal display devices, including twisted-nematic liquid crystal layers having a bistable character, are described.

It is understood, however, that the present invention is not limited to these embodiments. For example, it is appreciated that the methods of fabricating and driving the liquid crystal display in the present invention are adaptable to any form of liquid crystal display device. Other embodiments will be apparent to those skilled in the art upon reading the following description.

The present invention provides a liquid crystal display device of high display quality, capable of achieving a high speed driving over a wider range of temperatures for stable operations, and a method of driving a liquid crystal display device.

Referring to the Figures, a bistable twisted-nematic (BTN) liquid crystal display device and a method of driving the display device in accordance with the present invention will be described hereinbelow.

Figure 1:
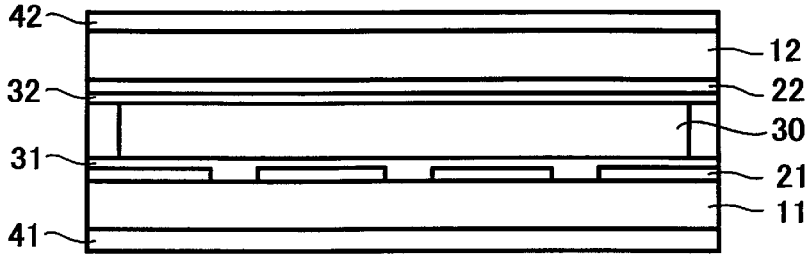
FIG. 1 is a cross-sectional view of a liquid crystal display cell in accordance with the present invention.

The display device includes a plurality of liquid crystal display cells, one of which is illustrated in FIG. 1. This display cell is one exemplary embodiment of the present invention and only one of a plurality of such cells which are included on an entire liquid crystal display.

As illustrated in FIG. 1, a liquid crystal display cell, having a bistable character, includes a layer 30 of liquid crystals placed between a pair of opposing light transparent substrates 11, 12, which are provided with respective transparent electrodes 21, 22 for applying voltages, and respective alignment films 31, 32 for aligning liquid crystals, and respective polarizers 41, 42.

In the present invention, a liquid crystal material is preferably used, including a chiral-nematic liquid crystal material, having a positive dielectric anisotropy and a ratio of its unstrained pitch to a liquid crystal cell spacing of approximately from 1 to 3.

Using the aforementioned alignment films 31,32, liquid crystal molecules are tilt-aligned in the cell to have a slight angle of inclination relative to the face of the substrates 11,12 and the angles of inclination relative to each of the substrates 11,12 to have the opposite sign. The angle of the inclination is preferably from 2° to 30°. It has been found that, for inclination angle values smaller than the above-mentioned, the bistability of the liquid crystal material becomes less stable resulting in a less satisfactory switching behavior, while, for larger values of the inclination an undesired increase in viewing angle dependence of the display quality results.

Also, in the present invention, the liquid crystal cells may preferably have a Δnd value of about one half of a light wavelength presently used for viewing the display, or from 0.20 to 0.35 micron and more preferably from 0.25 to 0.3 micron, wherein Δn and d represent an optical anisotropy value of the liquid crystal material and the thickness of the liquid crystal layer 30, respectively.

The two polarizers 42,41 are respectively disposed on top and bottom faces of the cell substrates 12,11. The direction of transparency axis of one of the polarizers is arranged to have an angle of about 45°, or of from 35° to 55°, between the alignment direction of an underlying alignment film, while the direction of transparency axis of the other polarizer is arranged to be symmetric with respect to the alignment direction.

Among device characteristics of bistable twisted-nematic (BTN) liquid crystal devices, switching behaviors of liquid crystal cells will be described hereinbelow.

As a plurality of voltages to be applied to drive a liquid crystal cell of FIG. 1, driving pulse voltages include (1) a pulse voltage to induce the Freedricksz transition of liquid crystal molecules, which is hereinafter referred to as a "reset pulse", and (2) a succeeding pulse voltage to select either one of metastable states caused by the relaxation from the above-mentioned induced state, which is referred hereinafter to as a "second pulse".

The amplitude of the reset pulse may be adjusted to be larger than a threshold voltage ($V_{th}$) necessary to cause changes from an initial state to the metastable states and the second pulse may be adjusted in comparison with a critical voltage ($V_C$) necessary to switch from one of the metastable states to the other metastable state.

When the amplitude of the second pulse is smaller than a critical value, a reversed rearrangement or a backward flow in the molecular orientation from the induced state (i.e., homeotropic state) takes place due to a rapid relaxation, and the molecules become twisted further by 180° from an initial arrangement. Namely, if the initial twist angle is 180°, this rearrangement results in a 360° twist angle, which is approximately the same angle as that of the aforementioned metastable state with a 360° twist angle. This 360° twisted state is hereinafter referred to as a T-metastable state and gives rise to a dark state of the display device of the present construction including the alignment of the polarizers 41,42.

By contrast, when the amplitude of the second pulse is larger than the critical value, the reversed rearrangement is suppressed and the molecules become stable at a twist angle smaller by 180° from an initial arrangement. For the 180° initial twist angle, namely, this rearrangement results in a 0° twist angle, which is approximately the same angle as that of the other metastable state with a 0° twist angle. This 0° or untwisted state is hereinafter referred to as a U-metastable state and gives rise to a bright state of the display device.

The changes of transmittance in a liquid display cell with a plurality of applied voltages are illustrated in FIGS. 2*a* through 2*d* as follows.

Figure 2A:
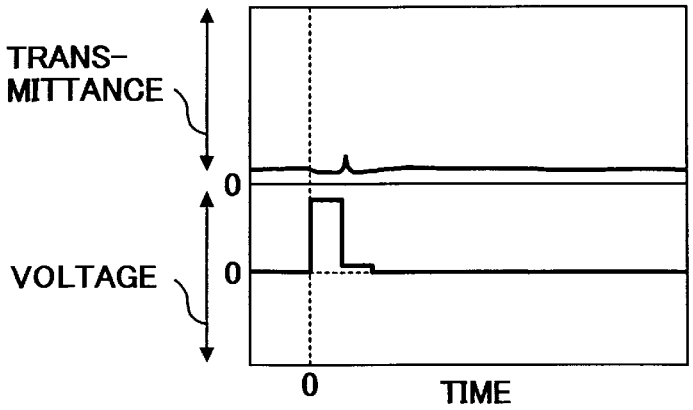
FIG. 2*a* is a graph of cell transmittance as a function of time comparing transmittance and pulse voltages, illustrating an application of a unipolar reset pulse and a succeeding unipolar second pulse having an amplitude smaller than a threshold voltage to result in a dark state.
Figure 2B:
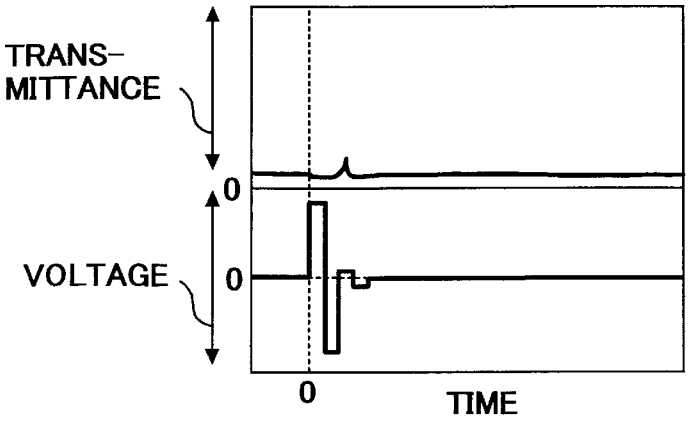
FIG. 2*b* is similar to FIG. 2*a* except that both the reset and second pulse are bipolar and the bipolar second pulse has an amplitude smaller than a threshold voltage to result in a similar dark state.
Figure 2C:
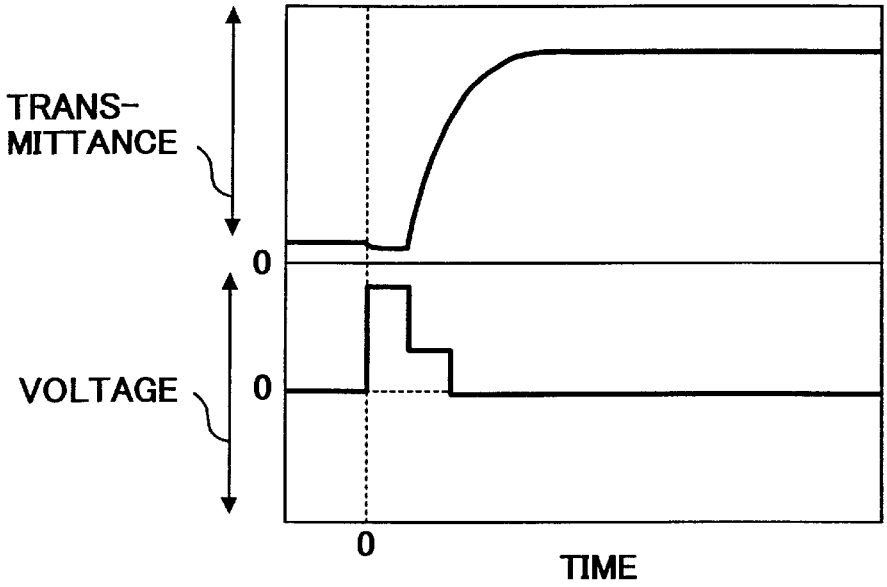
FIG. 2*c* is similar to FIG. 2*a* except that the unipolar second pulse has an amplitude larger than the threshold voltage to result in a bright state.
Figure 2D:
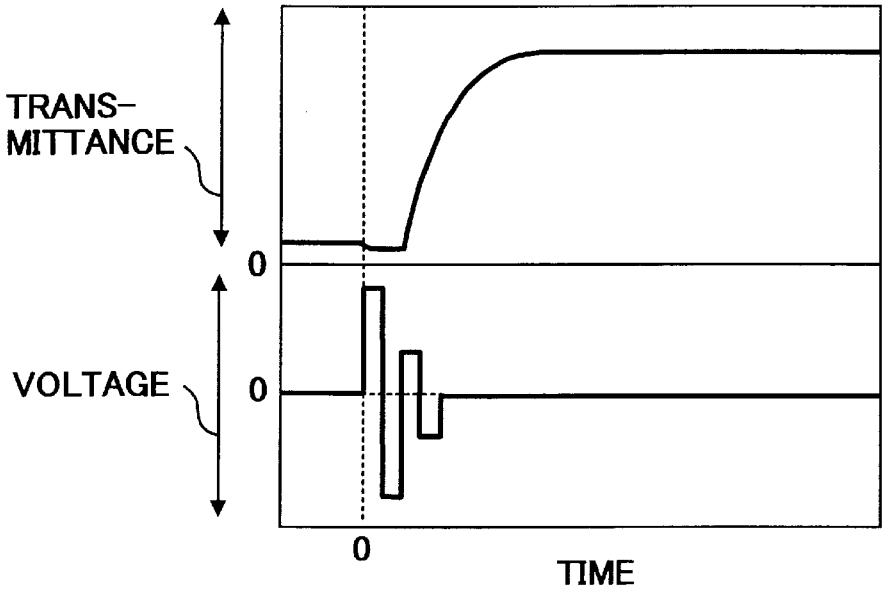
FIG. 2*d* is similar to FIG. 2*b* except that the bipolar second pulse has an amplitude larger than the threshold voltage to result in a similar bright state.

FIG. 2*a* represents the case of an application of a unipolar reset pulse and a succeeding unipolar second pulse having an amplitude smaller than a threshold voltage to result in a dark state. FIG. 2*b* is similar to FIG. 2*a* except that both the reset and second pulse are bipolar and the bipolar second pulse has an amplitude smaller than a threshold voltage to result in a similar dark state. FIG. 2*c* is similar to FIG. 2*a* except that the unipolar second pulse has an amplitude larger than the threshold voltage to result in a bright state. Likewise, FIG. 2*d* is similar to FIG. 2*b* except that the bipolar second pulse has an amplitude larger than the threshold voltage to result in a similar bright state.

These reset and second voltages may also be unipolar as well as bipolar. For a liquid crystal layer not to suffer from the accumulation of electric charges, the unipolar pulses may be applied by changing their polarity periodically, or in every other scan line, or in every certain number of lines.

As described earlier, two metastable states are formed by the relaxation from the initial state and the selection of either one of these two metastable states is determined by waveforms of applied voltages and by a ratio of d/P, wherein d and P represent the cell spacing of a liquid crystal cell and unstrained pitch of the liquid crystal material, respectively.

Figure 3:
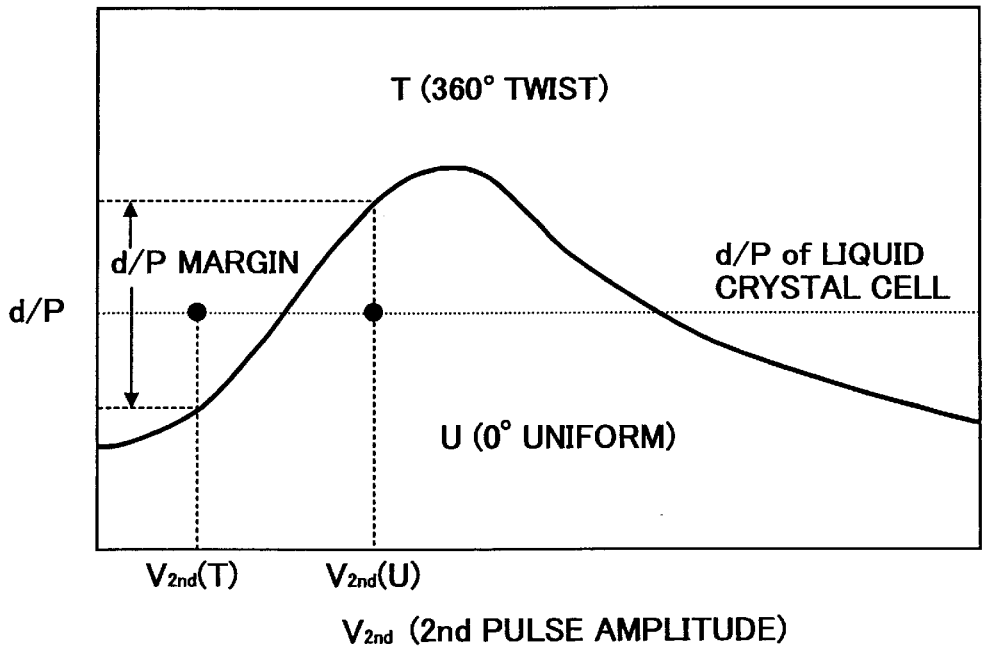
FIG. 3 is a graph of d/P ratio as a function of pulse amplitude of a second pulse $V_{2nd}$ applied to select either T or U states following application of a reset pulse.

FIG. 3 is a graph of d/P ratio as a function of pulse amplitude $V_{2nd}$ of the second pulse which is applied to select the metastable states. When waveforms of the reset pulse and width $W_{2nd}$ of second pulses are both fixed, the selection of metastable states is found considerably affected by the d/P ratio and a pulse amplitude of the second pulse $V_{2nd}$.

As to the d/P ratio, in general, increased d/P values tend to give rise to a T metastable state, while decreased d/P values result in a U metastable state. In addition, the d/P value which divides these metastable states changes with an amplitude of second pulses, as illustrated in FIG. 3. Accordingly, for a d/P value which may be determined by the liquid crystal cell presently used, a critical amplitude is defined as the amplitude corresponding to the d/P value mentioned just above. By applying a second pulse having an amplitude larger than the critical amplitude, a U metastable state results, while a T state results for an amplitude smaller than that value.

In practical operations of the liquid crystal cell presently having the values d and P, a d/P range can therefore be found as a range of the aforementioned d/P ratio, for which the selection between two metastable states can be properly achieved. This range is hereinafter referred to as a "d/P margin". Also, in practical operations the d/P margin can be taken as the difference between $V_{2nd}(U)$ and $V_{2nd}(T)$, as represented by an arrow in FIG. 3.

The greater the difference between $V_{2nd}(U)$ and $V_{2nd}(T)$, the wider the d/P margin. This is generally more advantageous for the cell operations due to a greater allowance for scattering in the cell spacing during manufacturing. However, for multiplexed operations of a display device of which pixels are constituted with scan and signal electrodes connected thereto, a voltage with a magnitude of at least $(V_{2nd}(U)-V_{2nd}(T))/2$ has to be supplied to the pixels even during non-selected or non-addressed periods. When the $(V_{2nd}(U)-V_{2nd}(T))$ value becomes unduly large, reduction in cell transmittance and display characteristics may result. This, in turn, imposes a certain limitation on the value of the d/P margin.

In addition, the effects of temperature on the d/P margin has to be considered. The d/P range for the selection of U and T states changes with temperature as illustrated in FIG. 3. The d/P value which corresponds to the boundary between U and T states tends to increase with decreasing temperature, while it decreases with increasing temperature. For liquid crystal cells having a relatively small d/P margin, therefore, the above-mentioned d/P change with temperature may result in disadvantages such that switching behavior between U and T states may be hindered or a temperature range may be reduced for which the switching behavior can be properly achieved.

Figure 4:
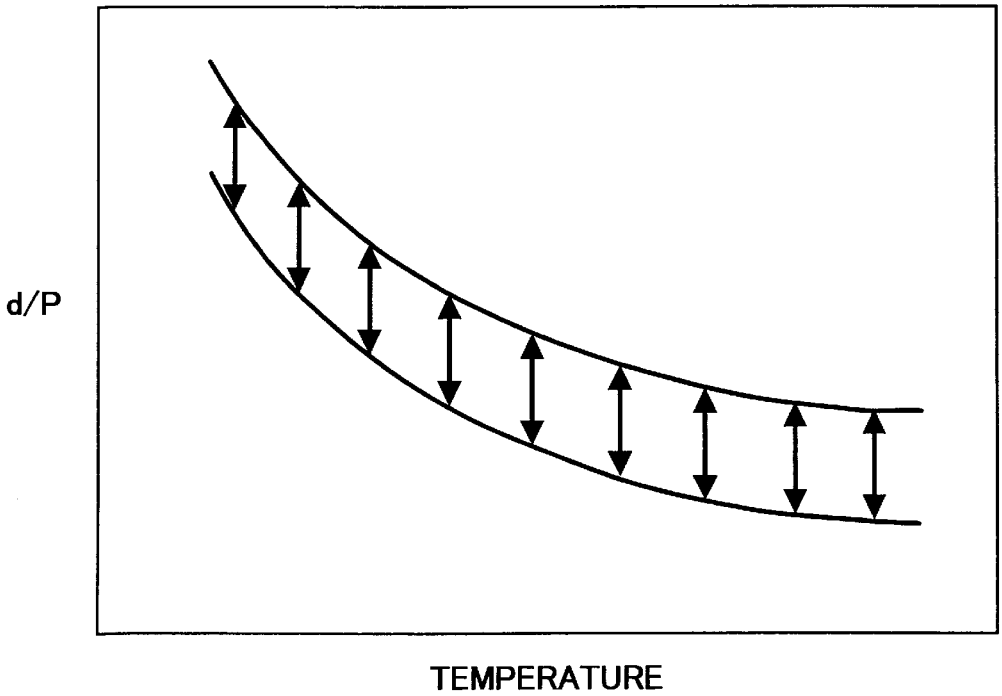
FIG. 4 is a graph of d/P ratio as a function of temperature, for which switching behavior between U and T states is achieved.

In FIG. 4, the variation of d/P ratio is illustrated as a function of temperature, for which switching behavior between U and T states is achieved under fixed voltage conditions.

In one aspect of the method of driving the liquid crystal display device of the present invention, at least either one of amplitude or width of a first voltage is not fixed but is arbitrarily adjusted to initiate the Freedricksz transition and to reset the state of the liquid crystal molecules to an initial state.

As described earlier, although the d/P range for selecting either U or T states changes with temperature, the present inventors have found that a similar change occurs with the magnitude of a reset pulse voltage (i.e., pulse amplitude or width). Namely, the d/P value which corresponds to the boundary between U and T states tends to increase with a decreasing reset pulse voltage (i.e., pulse amplitude or width), while it decreases with an increasing reset pulse voltage.

By adjusting the magnitude of the reset pulse, accordingly, the change of d/p value with temperature can be compensated for. More specifically, the adjustments can be achieved such that, for an increase in temperature (i.e., decrease in d/P value corresponding to the above-mentioned boundary), a reset pulse voltage is decreased to thereby increase the d/P value, while for a decrease in temperature, a reset pulse voltage is increased.

In another aspect of the method of driving the liquid crystal display device of the present invention, a first voltage used to initiate the Freedricksz transition of a layer of the liquid crystal material is a pulse voltage with a magnitude equal to or greater than a threshold voltage ($V_{th}$) which is determined with respect to an initial state and the two metastable states, and a second voltage used to select either the first or second metastable state is a pulse voltage with a magnitude which is determined with respect to a critical value ($V_C$) which is related to a potential difference between the metastable states.

By such adjustment of pulse voltages, the liquid crystal layer can be properly brought to a reset state, and is assured to subsequently be selectively transited to either the U or T state. These adjustments may be made through either adjusting pulse amplitude or width. However, since the adjustment of the width may generally cause a change in the driving frequency of the device, adjustment of only amplitude is preferred to avoid the frequency change.

Also, by driving the device with these voltage adjustments, a liquid crystal display device having a larger display capacity and a proper switching capability over a wide range of temperatures becomes feasible. This is particularly advantageous for a display device having a display panel which includes a plurality of delineated electrodes on each substrate to serve as scan electrodes or signal electrodes, and in which each of the electrodes is capable of being individually addressed in a multiplexed fashion by a device for applying voltages.

In still another aspect of the method of driving the liquid crystal display device of the present invention, a third voltage $V_{ns}$ applied to maintain the selected metastable state is a pulse voltage with a magnitude smaller than a threshold voltage $V_{th}$ which is determined as a non-selected voltage $(V_{2nd}(U)-V_{2nd}(T))/2$ in comparison to the initial state and two metastable states.

Through the adjustment of the third voltage, the metastable state previously selected by the second pulse may be properly maintained. For $V_{ns}$ values greater than $V_{th}$, the selection between U and T states can not be properly achieved, that is, the liquid crystal layer is always set at the reset state. In addition, the third voltage $V_{ns}$ applied to maintain the selected metastable state is preferably a pulse voltage with a magnitude smaller than the critical value $V_C$ which is a potential difference between the metastable states. Through the adjustment of the third voltage, the metastable state may be properly maintained.

In another aspect of the method of driving the liquid crystal display device of the present invention, a liquid crystal material contained between the insulating substrates preferably has a kinetic viscosity equal to or smaller than 17 ($mm^2$/sec) at 20° C.

The present inventors have found that (1) d/P margin is closely related to a kinetic viscosity value of a liquid crystal material presently used, and (2) the smaller the kinetic viscosity value, the larger the d/P margin, while the larger the viscosity value, the smaller the d/P margin. This is considered to be related to the speed of the transition of the liquid crystal molecules to the reset state in such a manner that (1) as the kinetic viscosity value is smaller, the liquid crystal molecules approach the homeotropic state more completely at the final stage during the application of the reset pulse, (2) this results in larger back-flow movements (or a greater speed of relaxation from the reset state) succeeding the reset pulse, (3) this thus results in a larger difference in the ordered state of liquid crystal molecules under applied voltages $V_{2nd}(U)$ and $V_{2nd}(T)$, and (4) this gives rise to the increase in the d/P margin.

Using a plurality of liquid crystal materials varying in kinetic viscosity values during experimentation, a relatively large d/p margin is found for a kinetic viscosity value equal to or less than 17 ($mm^2$/sec).

Furthermore, a liquid crystal material contained in the display cell preferably has a kinetic viscosity equal to or smaller than 40 ($mm^2$/sec) at 0° C. As described above, the d/P margin is closely related to a kinetic viscosity value of a liquid crystal material presently used and preferably has a kinetic viscosity equal to or smaller than 17 ($mm^2$/sec) at 20° C. or at room temperature.

The kinetic viscosity value is temperature dependent, in general, and increases with decreasing temperature. This may result in reduced d/P margin with decreasing temperature and a shift of the median of the aforementioned d/P range.

During experimentation at 0° C. using a plurality of liquid crystal materials varying in kinetic viscosity values of at most 17 ($mm^2$/sec) at 20° C. and also of at most 40($mm^2$/sec) at 0° C., there have been found (1) a relatively small decrease of the d/P range with decreasing temperature, and (2) a relatively wide range of temperature in which the selection between U and T states is properly carried out under the above-mentioned various driving conditions of the display device.

In another aspect of the method of driving the liquid crystal display device of the present invention, a liquid crystal material contained in the display cell preferably has an anisotropy of dielectric constant equal to or greater than 3.0.

The d/P margin is closely related to an anisotropy of dielectric constant $\Delta\in$ of a liquid crystal material presently used as well as its kinetic viscosity value described above, and the d/P margin tends to increase with increasing $\Delta\in$ value, while it decreases with decreasing $\Delta\in$ latter value.

During experimentation using a plurality of liquid crystal materials varying in $\Delta\in$ values, a relatively large d/p margin is found for $\Delta\in$ values of approximately equal to or less than 17 ($mm^2$/sec).

In another aspect of the method of driving the liquid crystal display device of the present invention, a device for applying voltages is further provided with a control to arbitrarily adjust at least either one of amplitude or width of the first voltage applied to initiate the Freedricksz transition.

As seen on liquid crystal display devices mounted on various computer devices such as, for example, laptop personal computers and word processors, there have been provided control knobs for an operator to adjust display quality. In the BTN type display devices of the present invention a similar measure is also taken for an operator to be able to arbitrarily adjust a magnitude of reset pulses, thereby acquiring driving methods for achieving an excellent display quality of the liquid crystal display device, which can be maintained over a wide range of temperatures.

Furthermore, the liquid crystal display device described just above is further provided with an additional control capable of automatically controlling the magnitude of a reset pulse. This additional control is constituted of a temperature sensor for sensing the temperature of the liquid crystal panel, and a memory (ROM) and its control circuit for storing a plurality of $V_R$ values which have been obtained in advance so as to properly achieve the switching behavior of the panel at various temperatures as illustrated in, for example, FIG. 3. These $V_R$ values are determined at various temperatures and are subsequently programmed by being stored in the memory to compensate the change with temperature in the d/P boundary values which are related to the magnitude of second pulses.

By sensing the temperature of the display panel and by supplying voltage signals output from the additional control, a display panel can be properly operated and can retain an excellent display quality over a wide range of temperatures even for BTN type liquid crystal displays without cautious adjustments by an operator.

Although the present invention has been described up to this point primarily on methods of operating the display devices, a display device using a bistable twisted-nematic (BTN) liquid crystal of the present invention will be further detailed hereinbelow.

The display device includes a plurality of liquid crystal display cells, one of which is illustrated in FIG. 1. This display cell is one exemplary embodiment of the present invention and only one of a plurality of such cells which are included on an entire liquid crystal display.

Referring to FIG. 1, a liquid crystal cell includes two transparent insulating substrates 11, 12 arranged substantially parallel, each with a confronting surface bearing respective transparent electrodes 21,22, a respective alignment film 31,32 disposed over the transparent insulating electrodes 11, 12, and a layer 30 of liquid crystal materials contained between the transparent insulating substrates 11, 12.

In the present invention, the liquid crystal material preferably used, including a chiral-nematic liquid crystal material, has a positive dielectric anisotropy and a ratio of its unstrained pitch to the liquid crystal cell spacing of from about 1 to 3.

In addition, the liquid crystal cell is constructed to be capable of being switched between first and second metastable states caused by relaxation from a state (or an initial state) previously formed by the Freedricksz transition. The first and second metastable states each correspond to the arrangement of the liquid crystal molecules being gradually twisted between the substrates by 360° for the first (or T) metastable state, and by 0° for the second (or U) metastable state, respectively.

The liquid crystal cells of the display device are further provided with a device (see FIGS. 8 and 9) for applying various voltages at transparent electrodes 21, 22. These voltages includes first, second, and third voltages, wherein the first voltage is used to initiate the Freedricksz transition of, (or to reset) the layer 30 of the liquid crystal material, the second voltage is used to select either the first or second metastable state of the liquid crystal material, and the third voltage is applied to maintain the selected metastable state.

In the present invention, at least one of either amplitude or width of the first voltage used to initiate the Freedricksz transition may preferably be adjusted.

Figure 8:
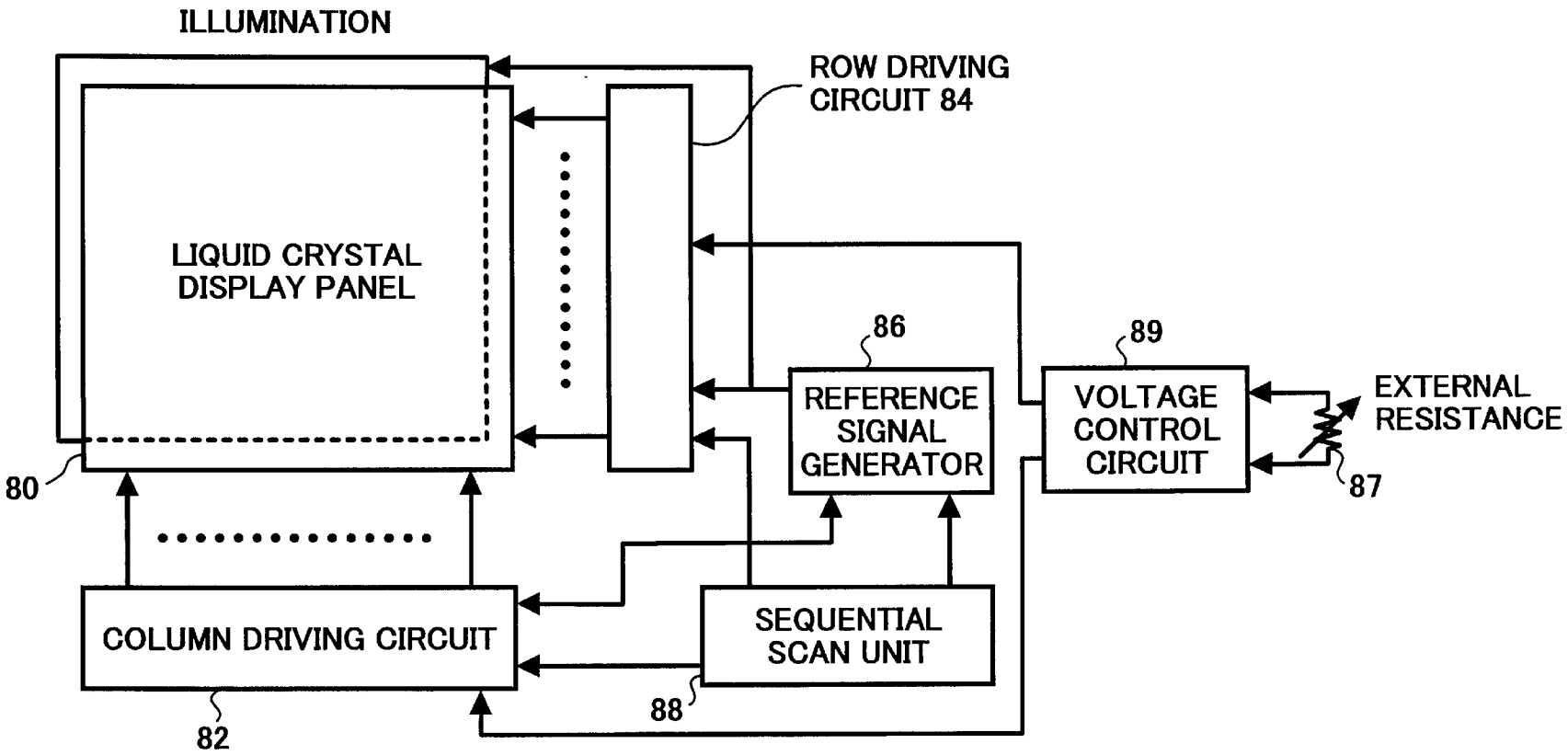
FIG. 8 is a block diagram of a control architecture for controlling a liquid crystal display device in accordance with the present invention.

In FIG. 8, a block diagram of a liquid crystal display device with its control architecture in accordance with one embodiment of the present invention is illustrated.

In one aspect of the liquid crystal display device of the present invention, at least either amplitude or width of a first voltage is not fixed but is arbitrarily adjusted to initiate the Freedricksz transition and to reset the state of the liquid crystal molecules.

As described earlier, although a d/P range for the selection between U and T states changes with temperature, the present inventors have found that a similar change is found with the change of a reset pulse voltage (i.e., pulse amplitude or width). That is, the d/P value which corresponds to the boundary between U and T states tends to increase with decreasing reset pulse voltage, while it tends to decrease with increasing reset pulse voltage.

By adjusting the magnitude of the reset pulse, accordingly, the change of d/p value with temperature can be compensated for.

More specifically, the adjustments can be achieved such that, for the increase in temperature (i.e., decrease in d/P value corresponding to the above-mentioned boundary), a reset pulse voltage is decreased to thereby increase the d/P value, while for the decrease in temperature, a reset pulse voltage increases.

The following examples are provided to further illustrate preferred embodiments of the present invention.

EXAMPLES

A liquid crystal display device was fabricated in accordance with the present invention. The display device includes generally a plurality of liquid crystal display cells, one of which is illustrated in FIG. 1. This display cell is one exemplary embodiment of the invention and only one of a plurality of such cells which are included on an entire liquid crystal display.

Referring to FIG. 1, a liquid crystal cell includes a pair of transparent insulating substrates 11,12 arranged substantially in parallel, each with a confronting surface bearing a respective transparent electrodes 21,22, a respective alignment film 31,32 disposed over the transparent electrode, a layer 30 of liquid crystal materials contained between the transparent insulating substrates 11,12, and respective polarizing plates 41,42 attached to each of outside surfaces of the substrates 11,12.

In the present invention, the liquid crystal material preferably used, including chiral-nematic liquid crystal material, has a positive dielectric anisotropy and a ratio of its unstrained pitch to the liquid crystal cell spacing of approximately from 1 to 3.

Furthermore, a liquid crystal display device was provided with a display panel, which includes a plurality of display pixels defined by delineated stripes of transparent electrodes and arranged in a matrix. The stripes of transparent electrodes were connected to driving circuits to serve as scanning and signal electrodes for driving the liquid crystal panel. By subsequently providing a back light on the rear side of the panel to illuminate the panel, a liquid crystal display device illustrated in FIG. 8 was fabricated.

The liquid crystal panel was controlled by a driving device as shown in FIG. 8. This driving device includes row 84 and column 82 driving circuits which supply driving voltages to row and column electrodes of pixels of the liquid crystal display panel 80, and a plurality of circuits which control the row 84 and column 82 driving circuits. The plurality of circuits included a reference signal generator 86, a sequential scanning circuit 88, and a voltage control circuit 89 with an external resistance 87.

Since operation methods and major characteristics of the display device were described earlier, descriptions specifically in accordance with several embodiments will be made hereinbelow.

Example 1

A liquid crystal display device according to one embodiment of the present invention was fabricated as follows.

On the surface of a first transparent substrate of glass, delineated transparent electrodes of indium tin oxide (ITO) were formed to serve as scanning or signal electrodes of the display device. The first substrate having the transparent electrodes was then coated with a layer of polyimide (AL-3046 from Japan Synthetic Rubber Co) and was subsequently alignment treated by rubbing the surfaces of the polyimide layer in a uniform direction.

A second substrate was also provided, in a similar manner as above, having transparent electrodes and an alignment treated polyimide layer. In order to form a wedge shaped liquid crystal cell, the second substrate was subsequently arranged spaced apart from the first substrate to have a cell spacing continuously changing from one end to the other of the cell by interposing spacers of plastic films of different thickness therebetween, and at each opposing end of the substrates. These first and second substrates were also positioned such that the polyimide layers were on inner confronting surfaces of the substrates and that directions of the alignment made a 180° angle (or anti-parallel) between the first and second substrates.

A liquid crystal material was disposed and then sealed between the substrates, whereby the above-mentioned wedge shaped liquid crystal cell was constituted.

Prior to sealing these substrates, a liquid crystal material was prepared with a nematic liquid crystal ZLI-1557 from Merck & Co (birefringence of $\Delta n=0.1147$), mixed with a chiral nematic liquid crystal S-811 from Merck & Co which induced a right-handed helical structure, so as to have a predetermined unstrained pitch (p) of 3.7 microns. It is noted for the present material that the change of the pitch with temperature is about 2% for 40 degrees from 0° C. to 40° C., which is negligibly small for practical purposes.

The liquid crystal cell was further provided with a pair of polarizers which were placed on the surfaces of the substrate opposite to the surfaces thereof which contact the liquid crystal material.

At this point, the transparent axes of the two polarizers were positioned to be perpendicular to each other such that each of the axes had a 45° angle with respect to the direction of the alignment treatment, being symmetric with respect to the alignment direction.

Using the wedge shaped liquid crystal cell thus prepared, the position of the boundary between U and T states in the cell could be observed under various experimental conditions. From the values of a cell spacing and the pitch (p) of a liquid crystal material, together with the above-mentioned position of the boundary, the range of the ratio d/p and the temperature dependence thereof was obtained, for which switching behavior between the U and T states was properly achieved. This switching accessible range is hereinafter referred to as a "d/p range", as described earlier.

In the present example, voltage pulses were adjusted as follows and applied in common throughout the measurements to a liquid crystal cell at various temperatures.

Reset pulse width ($W_R$): 2 msec;

2nd pulse width ($W_{2nd}$): 125 $\mu$sec;

Reset pulse amplitude ($V_R$): 25 volts.

In addition to these pulses, a couple of reset pulses were further applied individually, having amplitudes ($V_{2nd}$) of either 2.0 volts or 4.0 volts at a frame frequency of 50 Hz (20 msec/frame).

Figure 5:
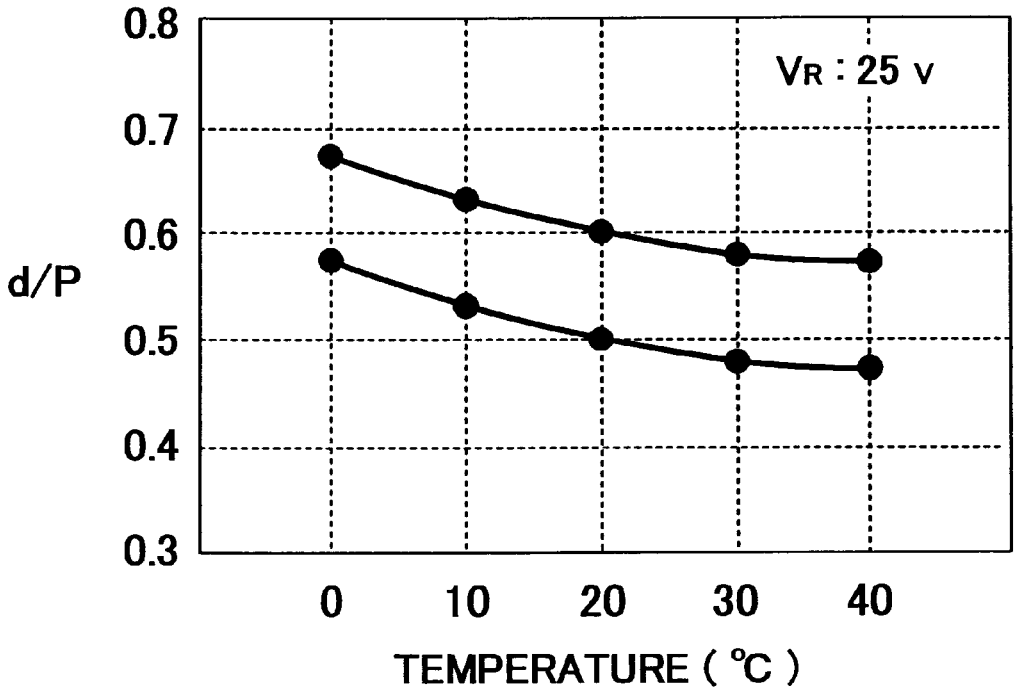
FIG. 5 is a graph of d/P ratio as a function of temperature, for which switching behavior between U and T states is achieved in accordance with a first embodiment of the present invention, wherein voltage pulses are applied having a reset pulse amplitude $V_R$ of 25 volts and a second pulse amplitude of either 2.0 volts or 4.0 volts.

When the above-mentioned position of the boundary between U and T states in the cell was observed under various experimental conditions, it was found that the "d/p range" changed considerably with temperature, and results of the measurements are shown in FIG. 5.

Figure 6:
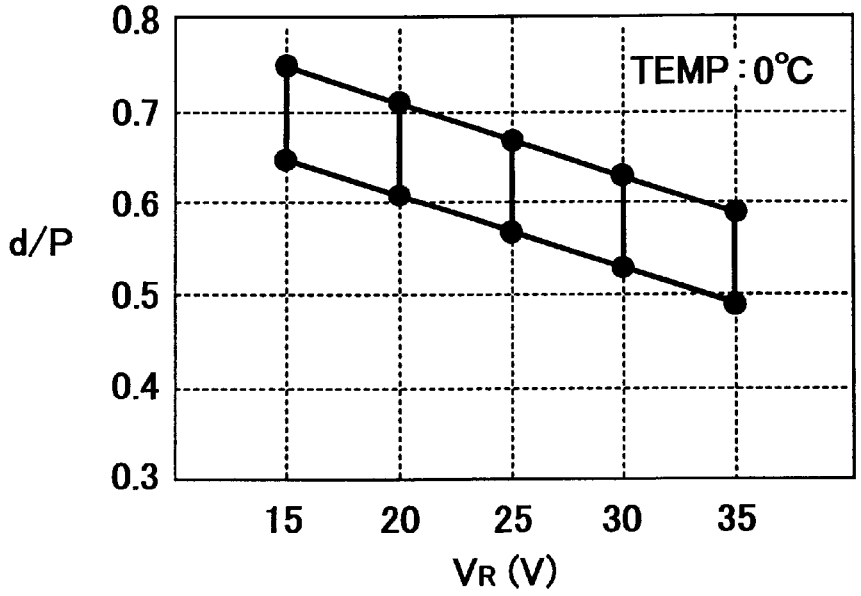
FIG. 6 is a graph of d/P ratio as a function of an amplitude of a reset pulse, for which switching behavior between U and T states is achieved at 0° C. in accordance with a first embodiment of the present invention.
Figure 7:
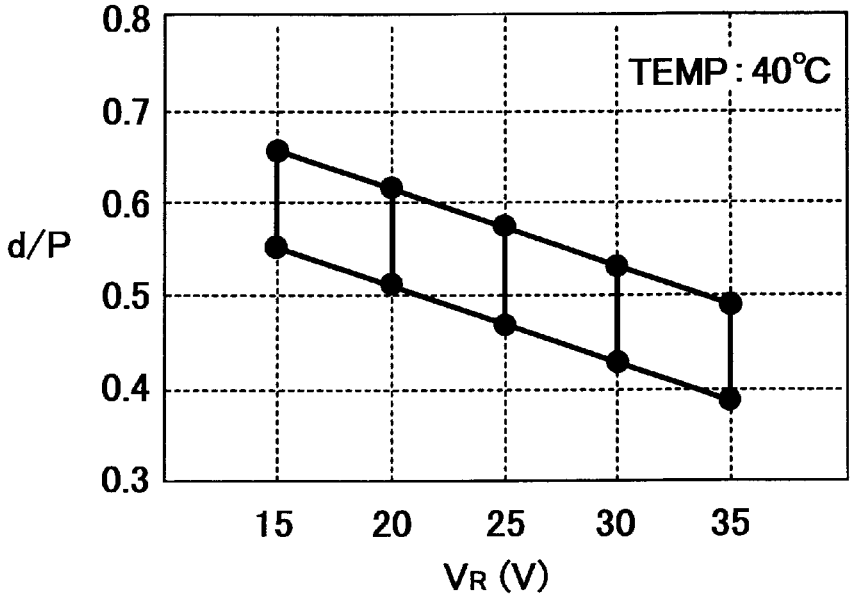
FIG. 7 is similar to FIG. 6 except that switching behavior between U and T states is achieved at 40° C.

Subsequently, another group of measurements was carried out at 0° C. and 40° C., with reset pulses varying in amplitudes ($V_R$), in place of the fixed 25 volts amplitude previously adopted, to observe d/p ranges and its $V_R$ dependence. The results from the measurements indicate that, by adjusting the amplitude of the reset pulse $V_R$, the value of d/p range can be brought approximately to that at an arbitrary temperature such as 20° C., for example, and that the value can be retained constant over a range of temperatures. The variations of the d/p range with the amplitude of the reset pulse VR were measured at 0° C. and 40° C. and the results are shown in FIGS. 6 and 7, respectively.

Examples 2 through 6 and Comparative Example 1

A liquid crystal cell was fabricated in a similar manner to Example 1, with the exception that the cell spacing was adjusted to be about 2.1 microns throughout the cell area by using silica beads having an approximately same diameter, in place of the spacing of the wedge shaped cells of Example 1, which changed continuously from one end to the other.

Switching characteristics of the display cell were subsequently examined at 20° C. by applying various reset and second pulses.

In the measurements, $W_R$ and $W_{2nd}$ were fixed to be 2 msec and 125 $\mu$sec, respectively, while $V_R$ and $V_{2nd}$ values changed.

The values of $V_{2nd}$(U) and $V_{2nd}$(T) were then obtained as threshold amplitudes to achieve the transition to U and T states, respectively. The averages of $V_{2nd}$(U) and $V_{2nd}$(T) values were calculated as critical values $V_C$ for the transition and are shown in Table 1. Also during the measurements, a $V_R$ value of 10 volts was intentionally adopted to supplement data as a comparative example, which results are also included in Table 1.

TABLE 1

| | $V_R$(volts) | $V_C$(volts) |
|---|---|---|
| COMPARATIVE EXAMPLE 1 | 10 | — |
| EXAMPLE 2 | 15 | 3.7 |
| EXAMPLE 3 | 20 | 3.3 |
| EXAMPLE 4 | 25 | 3.0 |
| EXAMPLE 5 | 30 | 2.7 |
| EXAMPLE 6 | 35 | 2.5 |

The results in Table 1 indicate (1) in Examples 2 through 6, a critical value $V_C$ was obtained for each $V_R$ value, and the switching between the two metastable states U and T was able to be accomplished by applying $V_{2nd}$ pulses which were appropriately determined from the $V_C$ values such that the amplitudes of $V_{2nd}$(U) and $V_{2nd}$(T) were respectively larger and smaller than $V_C$, and (2) in Comparative Example 1, however, the reset pulse $V_R$ was too small to accomplish the switching between U and T states and to thereby deduce its $V_C$ value.

Examples 7 through 10 and Comparative Example 2

Switching characteristics of liquid crystal cells were measured at 20° C. by applying various reset and second pulses with fixed values of $V_R$ of 25 volts and $W_{2nd}$ of 125 $\mu$sec, and with changing values of $W_R$ and $V_{2nd}$. The liquid crystal cells had the same construction as those used in the previous Examples 2 through 6.

In these measurements, by changing the $V_{2nd}$ value for each of the $V_R$ values, $V_C$ values were obtained in a similar manner as described earlier, as critical values between the two metastable states. Results from the measurements are shown in Table 2.

TABLE 2

| | $W_R$(msec) | $V_C$(volts) |
|---|---|---|
| COMPARATIVE EXAMPLE 2 | 0.25 | — |
| EXAMPLE 7 | 0.5 | 3.9 |
| EXAMPLE 8 | 1.0 | 3.4 |
| EXAMPLE 9 | 2.0 | 3.0 |
| EXAMPLE 10 | 4.0 | 2.5 |

The results in Table 2 indicate that (1) in Examples 7 through 10, a critical value $V_C$ was obtained for each $W_R$ value, and the switching between the two metastable states U and T can be accomplished by applying $W_R$ pulses which are appropriately determined from the $V_C$ values such that the amplitudes of $V_{2nd}$(U) and $V_{2nd}$(T) are respectively larger and smaller than $V_C$, and (2) in Comparative Example 2, however, the reset pulse $W_R$ was too small to securely reset the cell to thereby deduce its $V_C$ value.

Examples 11 through 30 and Comparative Examples 3 and 4

A liquid crystal device was fabricated in a similar manner to Examples 2 through 6. In addition, with previously disposed delineated stripes of transparent electrodes, a plurality of pixels were defined in a matrix to thereby constitute a liquid crystal panel. The stripes of transparent electrodes served as scanning and signal electrodes for driving the panel. The pixels on the panel were then driven in a multiplex fashion by supplying scanning and drive signals to the scanning and signal electrodes, respectively.

The signals were selected and supplied to the electrodes having fixed values such as $W_R$ of 2 msec, $V_R$ of 25 volts, and $W_{2nd}$(T) of 2 volts, while $V_{2nd}$(U) values changed. For each of the $V_{2nd}$(U) values, a non-selected voltage $V_{ns}=(V_{2nd}(U)-V_{2nd}(T))/2$ was calculated, and also the stability of the selected metastable state was observed visually. The results from the measurements are shown in Table 3.

It may be added for the pixel matrix that (1) $W_C$ and $W_{th}$ were found to be 3.0 volts and 11.0 volts, respectively, (2) the cell matrix was brought to the reset state for the non-selected voltage $V_{ns}$ larger than the 11.0 volts $V_{th}$, to thereby not be able to accomplish the selection of either U or T state, and (3) the stability of the selected metastable state was observed highest for the non-selected voltage $V_{ns}$ smaller than the 3.0 volts $V_C$, as indicated in Table 3.

TABLE 3

| | $V_{2nd}$(U) (volts) | $(V_{2nd}(U)-V_{2nd}(T))/2$ (volts) | Stability of selected metastable state |
|---|---|---|---|
| EXAMPLE 11 | 4 | 1.0 | ◎ |
| EXAMPLE 12 | 5 | 1.5 | ◎ |
| EXAMPLE 13 | 6 | 2.0 | ◎ |
| EXAMPLE 14 | 7 | 2.5 | ◎ |
| EXAMPLE 15 | 8 | 3.0 | ○ |
| EXAMPLE 16 | 9 | 3.5 | ○ |
| EXAMPLE 17 | 10 | 4.0 | ○ |
| EXAMPLE 18 | 11 | 4.5 | ○ |
| EXAMPLE 19 | 12 | 5.0 | ○ |
| EXAMPLE 20 | 13 | 5.5 | Δ |

TABLE 3-continued

| | $V_{2nd}$(U) (volts) | $(V_{2nd}(U)-V_{2nd}(T))/2$ (volts) | Stability of selected metastable state |
|---|---|---|---|
| EXAMPLE 21 | 14 | 6.0 | Δ |
| EXAMPLE 22 | 15 | 6.5 | Δ |
| EXAMPLE 23 | 16 | 7.0 | Δ |
| EXAMPLE 24 | 17 | 7.5 | Δ |
| EXAMPLE 25 | 18 | 8.0 | Δ |
| EXAMPLE 26 | 19 | 8.5 | Δ |
| EXAMPLE 27 | 20 | 9.0 | Δ |
| EXAMPLE 28 | 21 | 9.5 | Δ |
| EXAMPLE 29 | 22 | 10.0 | Δ |
| EXAMPLE 30 | 23 | 10.5 | Δ |
| COMPARATIVE EXAMPLE 3 | 24 | 11.0 | X |
| COMPARATIVE EXAMPLE 4 | 25 | 11.5 | X |

◎ No effects of $V_{ns}$ were observed on the stability of selected metastable state.
○ Although the selected state was maintained, slight effects were observed on cell transmittance.
Δ Although the selected state was maintained, a certain degree of instability was observed on cell transmittance.
X Reset states only were observed.

Examples 31 through 35 and Comparative Examples 5 through 10

A plurality of wedge shaped liquid crystal cells were fabricated in a similar manner to Example 1, with the exception that a variety of liquid crystal materials varying in kinetic viscosity values were disposed between the substrates.

Switching characteristics of the thus prepared liquid crystal cells were measured at 20° C. by applying various reset and second pulses with fixed values of $W_R$ of 2 msec, $W_{2nd}$ of 125 μsec, $V_R$ of 25 volts, and with $V_{2nd}$ of either 2.0 volts or 4.0 volts applied at a frame frequency of 50 hertz.

From the values of a cell spacing and the pitch (p) of a liquid crystal material, together with the above-mentioned position of the boundary, the aforementioned d/p margin was obtained, for which switching behavior between the U or T states was properly observed. The results from the measurements are shown in Table 4.

TABLE 4

| | Kinetic viscosity at 20° C. ($mm^2$/sec) | d/p margin |
|---|---|---|
| EXAMPLE 31 | 12 | 0.101 |
| EXAMPLE 32 | 13 | 0.082 |
| EXAMPLE 33 | 14 | 0.085 |
| EXAMPLE 34 | 15 | 0.071 |
| EXAMPLE 35 | 17 | 0.062 |
| COMPARATIVE EXAMPLE 5 | 19 | 0.029 |
| COMPARATIVE EXAMPLE 6 | 20 | 0.031 |
| COMPARATIVE EXAMPLE 7 | 21 | 0.025 |
| COMPARATIVE EXAMPLE 8 | 25 | 0.011 |
| COMPARATIVE EXAMPLE 9 | 30 | 0.005 |
| COMPARATIVE EXAMPLE 10 | 44 | — |

The results in Table 4 indicate that d/p margins of the relatively large magnitude were obtained in Examples 31 through 35, in which the kinetic viscosity values were equal to or less than 17 ($mm^2$/sec). By contrast, in Comparative Examples 5 through 10, where the values were larger than 17 ($mm^2$/sec), d/p margins were found relatively small.

Examples 36 through 40 and Comparative Examples 11 through 13

A plurality of wedge shaped liquid crystal cells were fabricated in a similar manner to Example 1, with the exception that a variety of liquid crystal materials were disposed between the substrates, wherein these materials had the same 17($mm^2$/sec) kinetic viscosity value at 20° C., while each had various different kinetic viscosity values at 0° C.

Switching characteristics of the thus prepared liquid crystal cells were measured at 20° C. or at 0° C. by applying various reset and second pulses with fixed values of $W_R$ of 2 msec, $W_{2nd}$ of 125 μsec, $V_R$ of 25 volts, and with $V_{2nd}$ of either 2.0 volts or 4.0 volts applied at a frame frequency of 50 hertz.

From the values of a cell spacing and the pitch (p) of a liquid crystal material, together with the above-mentioned position of the boundary, there were obtained for each cell (1) the aforementioned d/p margin, (2) the amount of the decrease in the d/p margin between 20° C. and at 0° C., and (3) the shift of the median of the d/p margin between 20° C. and at 0° C.

The results from the measurements are shown in Table 5.

TABLE 5

| | Kinetic viscosity at 20° C. ($mm^2$/sec) | Kinetic viscosity at 0° C. ($mm^2$/sec) | Decrease in d/p margin (20° C. → 0° C.) | Shift of median of d/p margin (20° C. → 0° C.) |
|---|---|---|---|---|
| EXAMPLE 36 | 14 | 35 | 0.01 | 0029 |
| EXAMPLE 37 | 13 | 37 | 0.0015 | 0035 |
| EXAMPLE 38 | 14 | 39 | 0.0018 | 0038 |
| EXAMPLE 39 | 15 | 40 | 0.0021 | 0046 |
| EXAMPLE 40 | 17 | 40 | 0.002 | 0041 |
| COMPARATIVE EXAMPLE 11 | 17 | 43 | 0.0049 | 0075 |
| COMPARATIVE EXAMPLE 12 | 15 | 45 | 0.0055 | 0079 |
| COMPARATIVE EXAMPLE 13 | 17 | 49 | 0.0061 | 0092 |

The results in Table 5 indicate that, in Examples 36 through 40, in which the kinetic viscosity values were equal to or less than 40 ($mm^2$/sec), the amount of the decrease in the d/p margin and the shift of the median of the d/p margin were both found to be relatively small, which are advantageous for practical purposes.

Examples 41 through 45 and Comparative Examples 14 through 16

A plurality of wedge shaped liquid crystal cells were fabricated in a similar manner to Example 1, with the exception that a variety of liquid crystal materials varying in anisotropy of dielectric constant $\Delta\in$ were disposed between the substrates.

Switching characteristics of the thus prepared liquid crystal cells were measured at 20° C. by applying various reset and second pulses with fixed values of $W_R$ of 2 msec, $W_{2nd}$ of 125 μsec, $V_R$ of 25 volts, and with $V_{2nd}$ of either 2.0 volts or 4.0 volts applied at a frame frequency of 50 hertz.

From the values of a cell spacing and the pitch (p) of a liquid crystal material, together with the above-mentioned position of the boundary, the aforementioned d/p margin was obtained, for which switching behavior between the U or T states was observed. The results from the measurements are shown in Table 6.

TABLE 6

| | $\Delta\epsilon$ | d/p margin |
|---|---|---|
| EXAMPLE 41 | 8.6 | 0.101 |
| EXAMPLE 42 | 7.4 | 0.094 |
| EXAMPLE 43 | 5.0 | 0.085 |
| EXAMPLE 44 | 4.6 | 0.073 |
| EXAMPLE 45 | 3.2 | 0.059 |
| COMPARATIVE EXAMPLE 14 | 2.7 | 0.027 |
| COMPARATIVE EXAMPLE 15 | 1.1 | 0.015 |
| COMPARATIVE EXAMPLE 16 | 0.24 | — |

The results in Table 6 indicate that d/p margins of the relatively large magnitude were obtained in Examples 31 through 35, in which $\Delta\in$ values were equal to or greater than approximately 3.0. By contrast, in Comparative Examples 14 through 16, in which the values were smaller than 3.0, d/p margins were found relatively small.

Example 46

A liquid crystal device was fabricated in a similar manner to Examples 2 through 6. With previously disposed delineated stripes of transparent electrodes, a plurality of pixels were defined as a matrix to thereby constitute a liquid crystal display panel. The stripes of transparent electrodes were connected to driving circuits to serve as scanning and signal electrodes for driving the liquid crystal panel.

In addition, to illuminate the panel, a back light was further provided on the rear side of the panel, whereby a liquid crystal display device illustrated in FIG. 8 was constructed.

The liquid crystal panel was controlled by a driving device of FIG. 8. The driving device included row 84 and column 82 driving circuits which supplied driving voltage waveforms to row and column electrodes of pixels of liquid crystal display panel 80 and a plurality of circuits which controlled the row 84 and column 82 driving circuits. The plurality of circuits included a reference signal generator 86, a sequential scanning circuit 88, and a voltage control circuit 89.

The driving means of the invention was further provided with an additional control of an adjusting knob (e.g., a variable external resistance 87 in FIG. 8), which enables an operator to arbitrarily adjust only $V_R$ values.

Switching characteristics of the thus prepared liquid crystal device were measured by supplying reset and second pulses with 2 msec $W_R$, 125 μsec $W_{2nd}$, 4 volt $V_{2nd}$(U), and 2 volt $V_{2nd}$(T).

Firstly, display image control signals were input to the panel at 20° C. When $V_R$ values were adjusted with the control knob such that the selection of U or T state was properly carried out on the panel, the $V_R$ value was found approximately 24 volts.

Subsequently, the panel was brought to and retained for one hour at 40° C., to confirm the selection of U or T state was not properly carried out with the 24 volt $V_R$ value. Instead, by adjusting the $V_R$ value with the control knob and decreasing to approximately 19 volts, the selection of U or T state was recovered.

Furthermore, when the panel was brought to and retained for one hour at 0° C., the panel was found not at U state but only at T state with the 19 volts $V_R$ value. By increasing the $V_R$ value with the control knob to approximately 33 volts, the selection of U or T state was recovered.

Example 47

Figure 9:
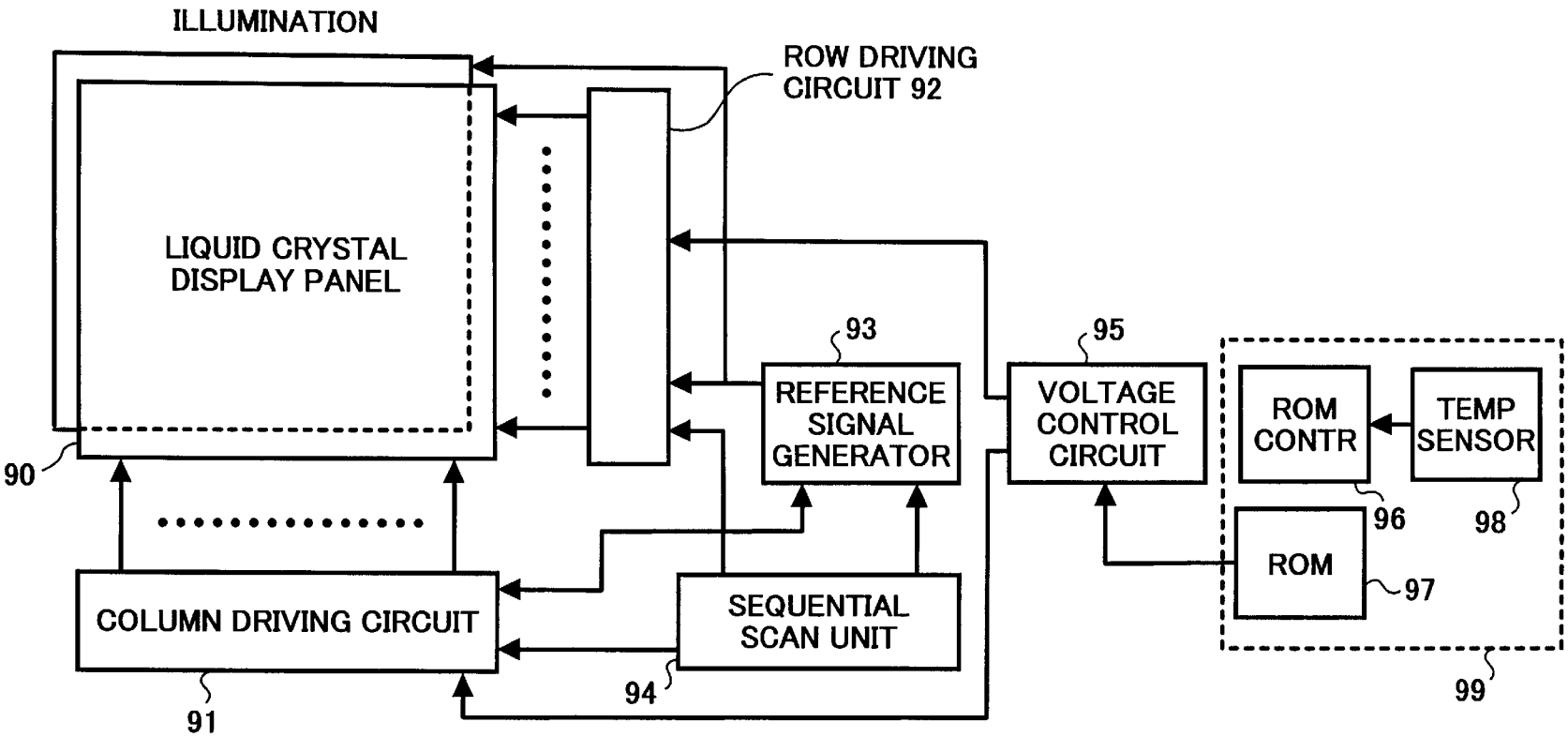
FIG. 9 is a further block diagram of a control architecture for controlling the liquid crystal display device in accordance with the present invention.

The liquid crystal display device of Example 46 was further provided with another additional control 99 as shown in FIG. 9 which is capable of automatically controlling the magnitude of a reset pulse. This additional control 99 includes a temperature sensor 98 for sensing the temperature of the liquid crystal panel 96 and a memory (ROM) 97 and its control circuit 96 for storing a plurality of $V_R$ values which were obtained in advance so as to properly achieve the switching behavior of the liquid crystal display panel 90 at various temperatures, whereby a liquid crystal display device illustrated in FIG. 9 was constituted.

Switching characteristics of the thus prepared liquid crystal device were then measured by supplying reset and second pulses with 2 msec $W_R$, 125 $\mu$sec $W_{2nd}$, 4 volt $V_{2nd}$(U), and 2 volt $V_{2nd}$(T). $V_R$ values were selected and programmed, considering (1) those previously obtained for the display panels in the aforementioned embodiments, which were composed of similar materials and had similar cell parameters, and (2) the dependence of the d/p margin on temperature and $V_R$ values. These $V_R$ values were subsequently stored in the memory to be utilized for controlling the device at temperatures sensed on the display panel.

During the measurements, display image control signals were input to the panel of which temperature was varied between 0° C. and 40° C., to examine whether the selection of U or T state was properly carried out with using the thus $V_R$ values programmed as above.

The results from the measurements indicate the selection of U or T state was properly carried out in that range of temperature.

Example 48

A liquid crystal device was fabricated in a similar manner to Example 47, with the exception that, on one of the substrates of liquid crystal display panel 96, red, green or blue color filters were provided in a matrix corresponding to individual pixels, thereby constituting a color display panel.

Switching characteristics of the thus prepared liquid crystal device were then observed by inputting display image control signals to the thus prepared panel and supplying reset and second pulses in similar manner to those in Example 47.

The results from the measurements indicate that the selection of U or T state and a satisfactory color display were properly carried out in that range of temperature.

This application is based on Japanese Patent Application No. 9-248820, filed with the Japanese Patent Office on Sep. 12, 1997, the entire contents of which are hereby incorporated by reference.

Additional modifications and variations of the present invention are possible in light of the above teachings. It is therefore to be understood that within the scope of the appended claims, the present invention may be practiced otherwise than as specifically described herein.

What is claimed is:

1. A method of driving a liquid crystal display device including a liquid crystal cell comprising the steps of:

providing the liquid crystal cell with a first voltage pulse to initiate Freedricksz transition of said layer of said liquid crystal material, and a second voltage used to select either said first or second metastable state of said liquid crystal material, and a third voltage used to maintain the selected metastable state;

sensing a temperature at the liquid crystal display device; and adjusting at least either an amplitude or width of said first voltage pulse used to initiate the Freedricksz transition based on the sensed temperature, to change a d/p value, wherein d and p represent cell spacing of the liquid crystal cell and unstrained pitch of the liquid crystal material, respectively.

2. A method of driving a liquid crystal display device including a liquid crystal cell including two substrates arranged in parallel, each substrate having a confronting surface bearing at least one transparent electrode, an alignment film disposed over said transparent electrode, a layer of liquid crystal material contained between said substrates, said liquid crystal material being chiral-nematic liquid crystal with a positive dielectric anisotropy, a surface of said alignment film being alignment treated with an anti-parallel alignment direction and pre-tilt angles formed on respective alignment film surfaces by the electrodes, said method comprising the steps of:

providing the liquid crystal cell with a first voltage pulse to initiate Freedricksz transition of said layer of said liquid crystal material, and a second voltage used to select either said first or second metastable state of said liquid crystal material, and a third voltage used to maintain the selected metastable state;

sensing a temperature at the liquid crystal display device; and adjusting at least either an amplitude or width of said first voltage pulse used to initiate the Freedricksz transition based on the sensed temperature, to change a d/p value, wherein d and p represent cell spacing of the liquid crystal cell and unstrained pitch of the liquid crystal material, respectively.

3. The method according to claim 2, wherein said first voltage used to initiate the Freedricksz transition of said layer of liquid crystal material is a pulse voltage with a magnitude equal to or greater than a threshold voltage $V_{th}$ determined with respect to an initial state and said two metastable states, and said second voltage used to select either said first or second metastable state of said liquid crystal material is a pulse voltage with a magnitude which is determined with respect to a critical value $V_C$ related to a potential difference between said metastable states.

4. The method according to claim 3, wherein said third voltage used to maintain the selected metastable state is a pulse voltage with a magnitude smaller than the threshold voltage $V_{th}$ determined with respect to an initial state and said two metastable states.

5. The method according to claim 3, wherein said third voltage used to maintain the selected metastable state is a pulse voltage with a magnitude smaller than said critical value $V_C$ determined with respect to a potential difference between said metastable states.

6. The method according to claim 2, wherein said liquid crystal cell further includes a plurality of delineated electrodes on each substrate to serve as scan electrodes or signal electrodes, and wherein each delineated electrode is capable of being individually addressed in a multiplexed fashion.

7. The method according to claim 6, wherein on one of said substrates of said liquid crystal display panel, red, green or blue color filters are provided in a matrix corresponding to individual pixels.

8. The method according to claim 2, further comprising the step of arbitrarily adjusting at least either the amplitude or width of said first voltage applied to initiate the Freedricksz transition.

9. The method according to claim 8, further comprising the step of sensing temperature of the liquid crystal panel, so as to adjust at least either the amplitude or width of said first voltage used to initiate the Freedricksz transition.

10. A method of driving a liquid crystal display device including a liquid crystal cell including two substrates arranged in parallel, each substrate having a confronting surface bearing at least one transparent electrode, an alignment film disposed over said transparent electrode, a layer of liquid crystal material contained between said substrates, said liquid crystal material being chiral-nematic liquid crystal with a positive dielectric anisotropy, a surface of said alignment film being alignment treated with an anti-parallel alignment direction and pre-tilt angles formed on respective alignment film surfaces by the electrodes, said method comprising the steps of:

providing the liquid crystal cell with a first voltage to initiate Freedricksz transition of said layer of said liquid crystal material, and a second voltage used to select either said first or second metastable state of said liquid crystal material, and a third voltage used to maintain the selected metastable state, adjusting at least either an amplitude or width of said first voltage used to initiate the Freedricksz transition, wherein said liquid crystal material contained between said substrates has a kinetic viscosity equal to or smaller than 17 ($mm^2$/sec) at 20° C.

11. The method according to claim 10, wherein said liquid crystal material contained between said substrates has a kinetic viscosity equal to or smaller than 40 ($mm^2$/sec) at 0° C.

12. The method according to claim 11, wherein said liquid crystal material contained between said substrates has an anisotropy of dielectric constant equal to or greater than 3.0.

13. A liquid crystal display device comprising:

a liquid crystal cell including two substrates arranged in parallel, each substrate having a confronting surface bearing at least one transparent electrode, an alignment film disposed over said at least one transparent electrode, a layer of liquid crystal material contained between said substrates, said liquid crystal material being chiral-nematic liquid crystal with a positive dielectric anisotropy, a surface of said alignment film being alignment treated with an anti-parallel alignment direction and pre-tilt angles formed on respective alignment film surfaces by a molecular axis of said liquid crystal material at an initial state being substantially equal to each other, a ratio of an unstrained pitch to a thickness of the layer of liquid crystal material being approximately from 1 to 3, said liquid crystal cell being switched between first and second metastable states caused by relaxation from a state previously formed by Freedricksz transition, the first and second metastable states corresponding to arrangements of said liquid crystal material gradually twisted between the substrates by 360° or 0°, respectively;

means for applying first, second, and third voltages between the electrodes, said first voltage being a pulse voltage used to initiate the Freedricksz transition of said layer of said liquid crystal material, said second voltage being used to select either said first or second metastable state of said liquid crystal material, and said third voltage being used to maintain the selected metastable state; and means for sensing a temperature at the liquid crystal display device;

wherein at least either an amplitude or width of said first voltage pulse used to initiate the Freedricksz transition is adjusted based on the sensed temperature, to change a d/p value, wherein d and p represent cell spacing of the liquid crystal cell and unstrained pitch of the liquid crystal material, respectively.

14. The liquid crystal display device according to claim 13, wherein said first voltage used to initiate the Freedricksz transition of said layer of said liquid crystal material is a pulse voltage with a magnitude equal to or greater than a threshold voltage $V_{th}$ determined with respect to an initial state and said two metastable states, and said second voltage used to select either said first or second metastable state of said liquid crystal material is a pulse voltage with a magnitude determined with respect to a critical value $V_C$ related to a potential difference between said metastable states.

15. The liquid crystal display device according to claim 14, wherein said third voltage Used to maintain the selected metastable state is a pulse voltage with a magnitude smaller than the threshold voltage $V_{th}$ determined with respect to an initial state and said two metastable states.

16. The liquid crystal display device according to claim 14, wherein said third voltage used to maintain the selected metastable state is a pulse voltage with a magnitude smaller than said critical value $V_C$ determined with respect to a potential difference between said metastable states.

17. The liquid crystal display device according to claim 13, wherein said liquid crystal cell further includes a plurality of delineated electrodes on each substrate to serve as scan electrodes or signal electrodes, and wherein each delineated electrodes is capable of being individually addressed in a multiplexed fashion by said means for applying a voltage.

18. The liquid crystal display device according to claim 17, wherein on one of said substrates of said liquid crystal display panel, red, green or blue color filters are provided in a matrix corresponding to individual pixels.

19. The liquid crystal display device according to claim 13, wherein said means for applying voltage is further provided with an additional control means to arbitrarily adjust at least either the amplitude or width of said first voltage applied to initiate the Freedricksz transition.

20. The liquid crystal device according to claim 19, wherein said additional control means for applying a voltage is further provided with automatic control means with a temperature sensor for sensing temperature of the liquid crystal panel, so as to adjust at least either the amplitude or width of said first voltage used to initiate the Freedricksz transition.

21. A liquid crystal display device comprising:

a liquid crystal cell including two substrates arranged in parallel, each substrate having a confronting surface bearing at least one transparent electrode, an alignment film disposed over said at least one transparent electrode, a layer of liquid crystal material contained between said substrates, said liquid crystal material being chiral-nematic liquid crystal with a positive dielectric anisotropy, a surface of said alignment film being alignment treated with an anti-parallel alignment direction and pre-tilt angles formed on respective alignment film surfaces by a molecular axis of said liquid crystal material at an initial state being substantially equal to each other, a ratio of an unstrained pitch to a thickness of the layer of liquid crystal material being approximately from 1 to 3, said liquid crystal cell being switched between first and second metastable states caused by relaxation from a state previously formed by Freedricksz transition, the first and second metastable states corresponding to arrangements of said liquid crystal material gradually twisted between the substrates by 360° or 0°, respectively; and means for applying first, second, and third voltages between the electrodes, said first voltage being used to initiate the Freedricksz transition of said layer of said liquid crystal material, said second voltage being used to select either said first or second metastable state of said liquid crystal material, and said third voltage being used to maintain the selected metastable state, wherein at least either an amplitude or width of said first voltage potential used to initiate the Freedricksz transition is adjusted, and wherein said liquid crystal material contained between said substrates has a kinetic viscosity equal to or smaller than 17 ($mm^2$/sec) at 20° C.

22. The liquid crystal display device according to claim 21, wherein said liquid crystal material contained between said substrates has a kinetic viscosity equal to or smaller than 40 ($mm^2$/sec) at 0° C.

23. The liquid crystal display device in accordance with claim 22, wherein said liquid crystal material contained between said substrates has an anisotropy of dielectric constant equal to or greater than 3.0.

24. A liquid crystal display device comprising:

a liquid crystal cell including two substrates arranged in parallel, each substrate having a confronting surface bearing at least one transparent electrode, an alignment film disposed over said transparent electrode, a layer of liquid crystal material contained between said substrates, said liquid crystal material being chiral-nematic liquid crystal with a positive dielectric anisotropy, a surface of said alignment film being alignment treated with an anti-parallel alignment direction and pre-tilt angles formed on respective alignment film surfaces by a molecular axis of said liquid crystal material at an initial state being substantially equal to each other, a ratio of an unstrained pitch to a thickness of the layer of said liquid crystal material being approximately from 1 to 3, said liquid crystal cell being switched between first and second metastable states caused by relaxation from a state previously formed by Freedricksz transition, the first and second metastable states corresponding to arrangements of said liquid crystal molecules gradually twisted between the substrates by 360° or 0°, respectively;

means for applying first, second, and third voltages between the electrodes, said first voltage being a pulse voltage used to initiate the Freedricksz transition of said layer of said liquid crystal material, said second voltage being used to select either said first or second metastable state of said liquid crystal material, and said third voltage being used to maintain the selected mestable state; and means for sensing a temperature at the liquid crystal display device;

wherein at least either an amplitude or width of said first voltage pulse used to initiate the Freedricksz transition is adjusted based on the sensed temperature, to change a d/p value, wherein d and p represent cell spacing of the liquid crystal cell and unstrained pitch of the liquid crystal material, respectively.

25. A liquid crystal display device comprising:

a liquid crystal cell including two substrates arranged in parallel, each substrate having a confronting surface bearing at least one transparent electrode, an alignment film disposed over said transparent electrode, a layer of liquid crystal material contained between said substrates, said liquid crystal material being chiral-nematic liquid crystal with a positive dielectric anisotropy, a surface of said alignment film being alignment treated with an anti-parallel alignment direction and pre-tilt angles formed on respective alignment film surfaces by a molecular axis of said liquid crystal material at an initial state being substantially equal to each other, a ratio of an unstrained pitch to a thickness of the layer of said liquid crystal material being approximately from 1 to 3, said liquid crystal cell being switched between first and second metastable states caused by relaxation from a state previously formed by Freedricksz transition, the first and second metastable states corresponding to arrangements of said liquid crystal molecules gradually twisted between the substrates by 360°or 0°, respectively; and means for applying first, second, and third voltages between the electrodes, said first voltage being used to initiate the Freedricksz transition of said layer of said liquid crystal material, said second voltage being used to select either said first or second metastable state of said liquid crystal material, and said third voltage being used to maintain the selected metastable state;

wherein at least either an amplitude or width of said first voltage potential used to initiate the Freedricksz transition is adjusted, and wherein said liquid crystal material contained between said insulating substrates has a kinetic viscosity equal to or smaller than 17 ($mm^2$/sec) at 20° C.

26. The liquid crystal display device according to claim 24, wherein said liquid crystal material contained between said substrates has a kinetic viscosity equal to or smaller than 40 ($mm^2$/sec) at 0° C.

27. The liquid crystal display device according to claim 25, wherein said liquid crystal material contained between said substrates has an anisotropy of dielectric constant equal to or greater than 3.0.

28. The liquid crystal display device according to claim 25, wherein said cell has a plurality of delineated electrodes on each substrate to serve as scan electrodes or signal electrodes, and wherein each delineated electrode is capable of being individually addressed in a multiplexed fashion by said means for applying a voltage.

29. The liquid crystal display device according to claim 25, wherein said means for applying a voltage is further provided with an additional control means to arbitrarily adjust at least either the amplitude or width of said first voltage applied to initiate the Freedricksz transition.

* * * * *